US005415531A

United States Patent [19]

Cavanaugh

[11] Patent Number: 5,415,531

[45] Date of Patent: May 16, 1995

[54] PISTON PUMP FOR FLUENT MATERIALS

[75] Inventor: James E. Cavanaugh, Cottage Grove, Oreg.

[73] Assignee: Binks Manufacturing Company, Franklin Park, Ill.

[21] Appl. No.: 223,652

[22] Filed: Apr. 6, 1994

[51] Int. Cl.[6] ..... F04B 35/00

[52] U.S. Cl. ..... 417/397; 417/403; 92/86; 277/212 FB

[58] Field of Search ..... 417/397, 398, 399, 403, 417/404; 92/86; 277/212 R, 212 FB

[56] References Cited

U.S. PATENT DOCUMENTS

| | | | |
|---|---|---|---|
| 4,029,442 | 6/1977 | Drath et al. . | |
| 4,035,109 | 7/1977 | Schlosser . | |
| 4,463,663 | 8/1984 | Hanson, Jr. et al. | 92/86 |
| 4,597,322 | 7/1986 | Garnjost et al. | 92/86 |
| 4,637,295 | 1/1987 | Powers et al. . | |
| 4,981,418 | 1/1991 | Kingsford et al. | 417/397 |
| 5,031,509 | 7/1991 | Cowan | 92/86 |
| 5,094,596 | 3/1992 | Erwin et al. | 417/397 |
| 5,152,540 | 10/1992 | Kuze | 277/212 FB |
| 5,176,390 | 1/1993 | Lallement | 92/86 |

FOREIGN PATENT DOCUMENTS

| | | | |
|---|---|---|---|
| 1212372 | 11/1963 | Germany | 277/212 FB |
| 0049480 | 4/1979 | Japan | 92/86 |

OTHER PUBLICATIONS

Binks/Poly-Craft, "Funny Pump," PM (Pail Mount) Pump Series, Bulletin A85-1A (product literature), pulication date unknown.

Binks/Poly-Craft, "Funny Pump" SM (Shelf Mount) Pump Series, Bulletin F-88-1 (product literature), circa 1988.

Binks/Poly-Craft, Model 450 Pump, Series "E," Bulletin H85-3 (product literature), Jul. 1, 1985.

Graco Inc., "The Glutton" Air Powered Pump, Bulletin 307-843 (product literature), publication date unknown.

*Primary Examiner*—Richard A. Bertsch
*Assistant Examiner*—Roland G. McAndrews, Jr.
*Attorney, Agent, or Firm*—Juettner Pyle Lloyd & Piontek

[57] ABSTRACT

A pump that is in essence leak-proof and prevents the escape to ambient atmosphere of environmentally hazardous fluent materials is comprised of an outlet block defining a pump chamber having a fluid inlet and a fluid outlet, a piston having one end reciprocable within the pump chamber and sealed to the outlet block, a piston rod connected to the other end of the piston for reciprocating the piston, a dynamic block secured to the outlet block and defining a sealed dynamic chamber within which the other end of the piston reciprocates, and an outlet from the dynamic chamber in continuous closed-circuit communication with a recirculating system for preventing escape into the environment of any fluent material that may leak past the piston seal. The pump also includes an articulated seal for sealing the piston rod to the dynamic chamber to maintain the sealed integrity of the chamber while at the same time accommodating reciprocation of the piston rod. In a preferred embodiment, two pumps are operated alternately by a reciprocating fluid motor, a common manifold provides for delivery of fluent material to the inlets of both pumps, and the dynamic chamber outlets are in closed-circuit communication with one another so that fluent material can course back and forth between the two chambers without impeding operation of the pumps.

16 Claims, 4 Drawing Sheets

Fig. 3
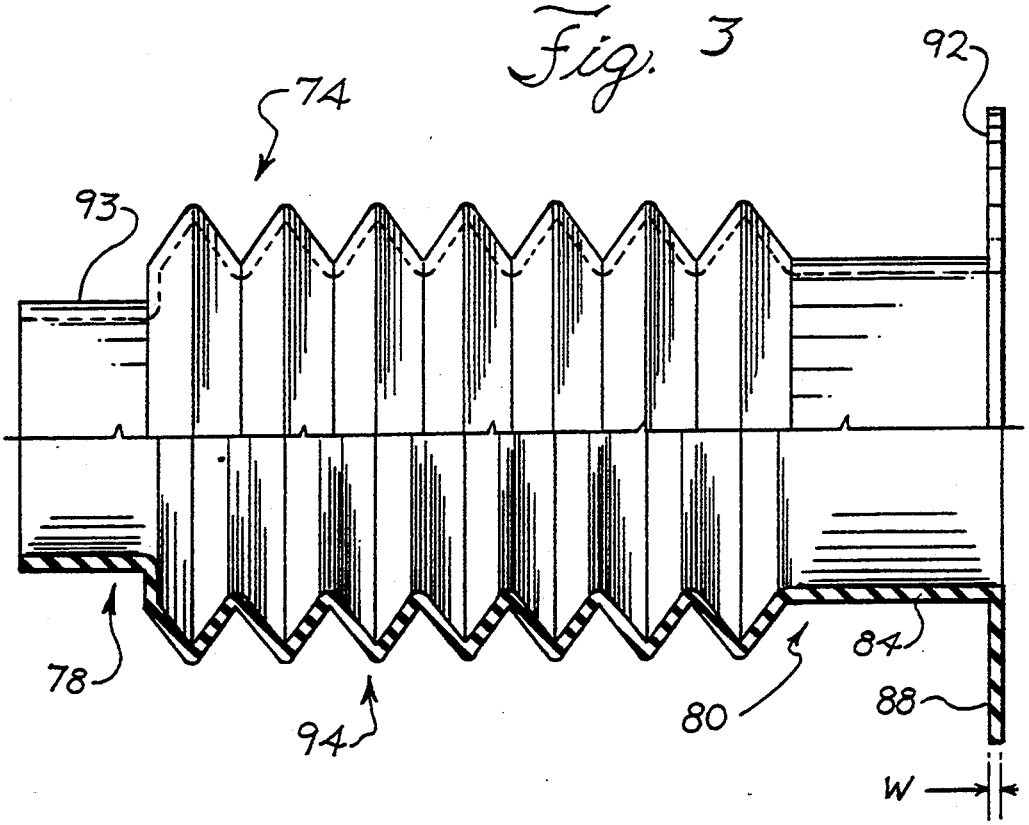
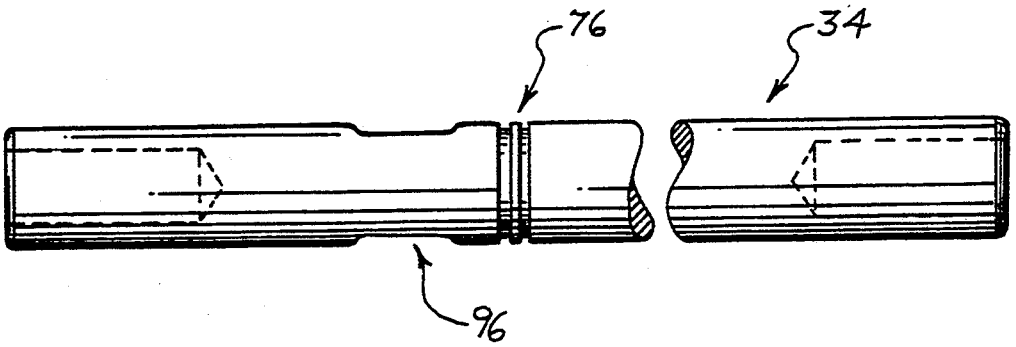
Fig. 4

PISTON PUMP FOR FLUENT MATERIALS

FIELD OF THE INVENTION

The present invention relates to an improved piston pump especially adapted for the pumping of viscous and/or abrasive fluent materials, and in particular, a pump assembly that is comprised of a pair of opposed single acting piston pumps operated alternately by means of an interposed actuator, such as a fluid actuated, dual acting motor, isolated from the fluent material.

BACKGROUND OF THE INVENTION

A pump assembly of the general type described above is disclosed in U.S. Pat. No. 5,094,596 to Erwin, Cavanaugh and Hetherington. This patent includes a description of a pump assembly having a piston stroke shorter than the pumping chamber, where the piston is maintained in continuous engagement with a piston seal. The cylinder within which the piston operates is provided with in-line inlet and outlet check valves to create a single pumping chamber for each pump, as opposed to separate intake and output chambers. Each pumping chamber is of substantially uniform diameter from the piston seal to the end wall of the chamber, and the inlet and outlet check valves are axially aligned with one another parallel to and immediately adjacent the end wall of the pumping chamber, so that fluid flow through the chamber is essentially a straight line of flow diametrically across the chamber without angular transitions. To maintain an essentially straight line path of flow, the reciprocatory stroke of the pump piston is maintained quite short. A short stroke of the piston is possible because the piston is not withdrawn from its seal, and the suction force of the piston is transmitted directly to the associated inlet check valve.

The short stroke in combination with the aforementioned pump assembly produced significant increases in pumping capacity, with less down-time and service requirements. In addition, in the event of failure of the seal assembly between the motor and the piston rod of either pump unit, motor fluid leaking from the motor through the seal assembly was prevented from entering into the path of flow of the fluent material in the pumping chamber and thus did not render the pump inoperable—the motor fluid was simply vented to the atmosphere harmlessly. This feature of the pump of the prior art facilitated operation of the motor by means of hydraulic fluid, since hydraulic fluid leaking from the actuator would not result in contamination of the fluent material and could likewise be drained away harmlessly.

However, although the aforementioned pump assembly resulted in significant improvements in the operation of the unit and in a significant decrease in the power required for a given amount of work, or conversely, a significant increase in the pumping capacity for a given energy input, potential drawbacks were visualized in the possible event of unrecovered leakage of certain fluent materials and the passage of such fluent materials to the environment.

The prior pump assembly was designed so as to accommodate leakage of the fluent material past the piston seal and venting of the fluent material to atmosphere, especially as piston seal wear became more pronounced. The area rearwardly of or behind the piston was configured as a static chamber vented to the atmosphere so as to avoid any fluent material impediment to, and consequent wasteful consumption of power on, the return or suction stroke of the piston. Fluent material thus collected in the static chamber could be vented away from the static chamber for disposal or recirculation back to the fluent material source of supply. Such venting of the fluent materials also allowed detection of leakage past the piston seal. By providing such a vent rearwardly of the piston, fluid leaking past the piston seal was readily observable, such that the amount of leakage would indicate to an operator an appropriate time to replace the seal. Venting of this space, however, also allowed the escape of the fluent materials.

When pumping expensive fluent materials (i.e., certain coating materials based on polymers) and environmentally controlled materials (i.e., coating materials containing highly volatile organic compounds (or so-called "VOCs") such as found in many solvents), it is important that the material not be wasted and that the VOCs not escape to the ambient atmosphere and thus the environment. In the case of the prior art, if the pump piston seal leaked, these disadvantages could occur.

Also, should corrosive solvents pass by the piston seal into the static chamber, a potential could be created for failure of the seal between the static chamber and the actuator, which could in some cases allow fluent material to continue into the actuator and intermingle with the motor fluid, such as air or hydraulic fluid. This could be especially problematic in situations where the fluent material is pre-charged prior to delivery to the pumping chamber. Seal failure could therefore result in damage to the pump, waste of expensive fluent materials, and passage to the atmosphere of environmentally controlled substances.

SUMMARY OF THE INVENTION

The object of the present invention is to provide a pump with all the advantages of the prior art pump discussed above which further overcomes the potential problems or deficiencies described.

A further object is to provide a pump having improved operational characteristics and a prolonged service life, which is adapted for a myriad of industrial uses and prevents the escape of expensive and/or environmentally controlled fluent materials to the atmosphere.

The invention is derived from and specifically improves upon the pump assembly disclosed in U.S. Pat. No. 5,094,596 (which is herein incorporated by reference) and corresponding pump assemblies sold by the common assignee, Binks Manufacturing Company. The improved pump assembly incorporates many of the proven elements of the aforementioned pump, including the same air motor, piston configuration and sealed pumping chamber. The invention resides in a new combination of structural features which together produce substantially enhanced operational and performance advantages and improvements over the disclosures of the above referenced prior art.

According to the present invention, the pump assembly includes a dynamic block and an outlet block, defining a dynamic chamber and a pumping chamber, respectively. The dynamic block abuts the outlet block, such that a cylindrical peripheral wall of the dynamic chamber is coaxial with and of substantially the same diameter as a cylindrical peripheral wall of the pumping chamber. The pumping chamber also has an end wall, proximate to which is placed an inlet to the output block and the pumping chamber and allowing selective communication of the pumping chamber with the fluent material delivery system, the inlet further having a check valve. An outlet from the output block and the pumping chamber is located proximate the pumping chamber end wall and is also in selective communication with the pumping chamber by means of a check valve.

A reciprocal actuator adjacent the dynamic chamber, having a short reciprocatory stroke, drives a reciprocating piston within the pumping chamber and the dynamic chamber. As in the aforementioned prior art, the piston is of a smaller diameter than the peripheral walls of the pumping chamber and the dynamic chamber so as to create an inwardly spaced gap relation thereto. The dynamic chamber also has an end wall separating the actuator from the dynamic chamber, through which a piston rod extends from the piston through an orifice in the end wall of the dynamic chamber to the actuator for coupling the piston with the actuator for imparting short reciprocal strokes of movement to the piston. An annular seal clamped between the outlet block and the dynamic block extends radially inwardly into engagement with the periphery of the piston, so as to seal the outlet block to the dynamic block and the outlet block to the piston. The periphery of the piston is in continuous engagement with the seal, and only the seal, and remains spaced from all other surfaces within the pump to minimize wear.

The piston rod is further provided with annular grooves, such that the annular grooves are positioned within the dynamic chamber. A first end of an articulating moveable seal member, preferably a bellows seal, is sealingly engaged in the annular grooves of the piston rod while a second end of the articulating moveable seal member sealingly engages the dynamic chamber end wall. An isolation chamber, located between the dynamic chamber and a seal assembly of the actuator, isolates and drains away any motor fluid, such as air or hydraulic fluid, which might pass through the seal assembly.

The articulating moveable seal member isolates the dynamic chamber from the actuator, and the interior of the seal is vented via the isolation chamber so that the seal may move without restriction, i.e., that the bellows may readily expand and contract. The seal member thereby seals the piston rod to the cylinder chamber end wall and creates a sealed dynamic chamber.

A characterizing feature of the invention resides in the establishment of continuous closed circuit communication between the two dynamic chambers of the pump assembly, and, in some instances, between the dynamic chambers and the check-valved inlet of the pump. The latter feature, in combination with the moveable bellows seal, provides an arrangement wherein the dynamic chamber can be filled with the fluent material being pumped thereby to establish a closed leak-proof fluent material circuit within the pump so that fluent material will not be wasted and contaminants, e.g., VOCs, cannot escape into the environment.

Further, the fluent material delivered to the pump inlet can be pressurized (or pre-charged) so that highly viscous fluent materials can readily be transported by the pump of the invention. Thus, for bulk storage systems with overhead storage tanks that impose a head pressure on the pump inlet, the present invention offers highly satisfactory performance. Moreover, any passage of pressurized fluent materials past the piston seal from the pumping chamber into the dynamic chamber is of no consequence to the integrity of the closed fluent material delivery circuit, as the fluent material is not allowed to escape to atmosphere.

Also, the construction and modular design of the present invention facilitates rapid disassembly and reassembly of each unit for inspection, repair and replacement of parts, with exceedingly little down time or loss of production.

The invention thus provides significant advantages over the prior art. Advantages and achievements in addition to those described will become apparent from the following detailed description, as considered in conjunction with the accompanying drawings.

BRIEF DESCRIPTION OF THE DRAWINGS

FIG. 3 is a fragmentary longitudinal sectional view, on a greatly enlarged scale, of the articulating moveable seal member, incorporated in the pump assembly of FIG. 1;

FIG. 4 is a plan view, on an enlarged scale, of the piston rod incorporated in the pump assembly of FIG. 1.

DETAILED DESCRIPTION OF PREFERRED EMBODIMENTS

The following is a description of the best mode presently contemplated by the inventor for carrying out his invention. Other modes of carrying out the invention, without departing from the scope of the invention, will become apparent to those skilled in the art as the description proceeds.

Figure 1:
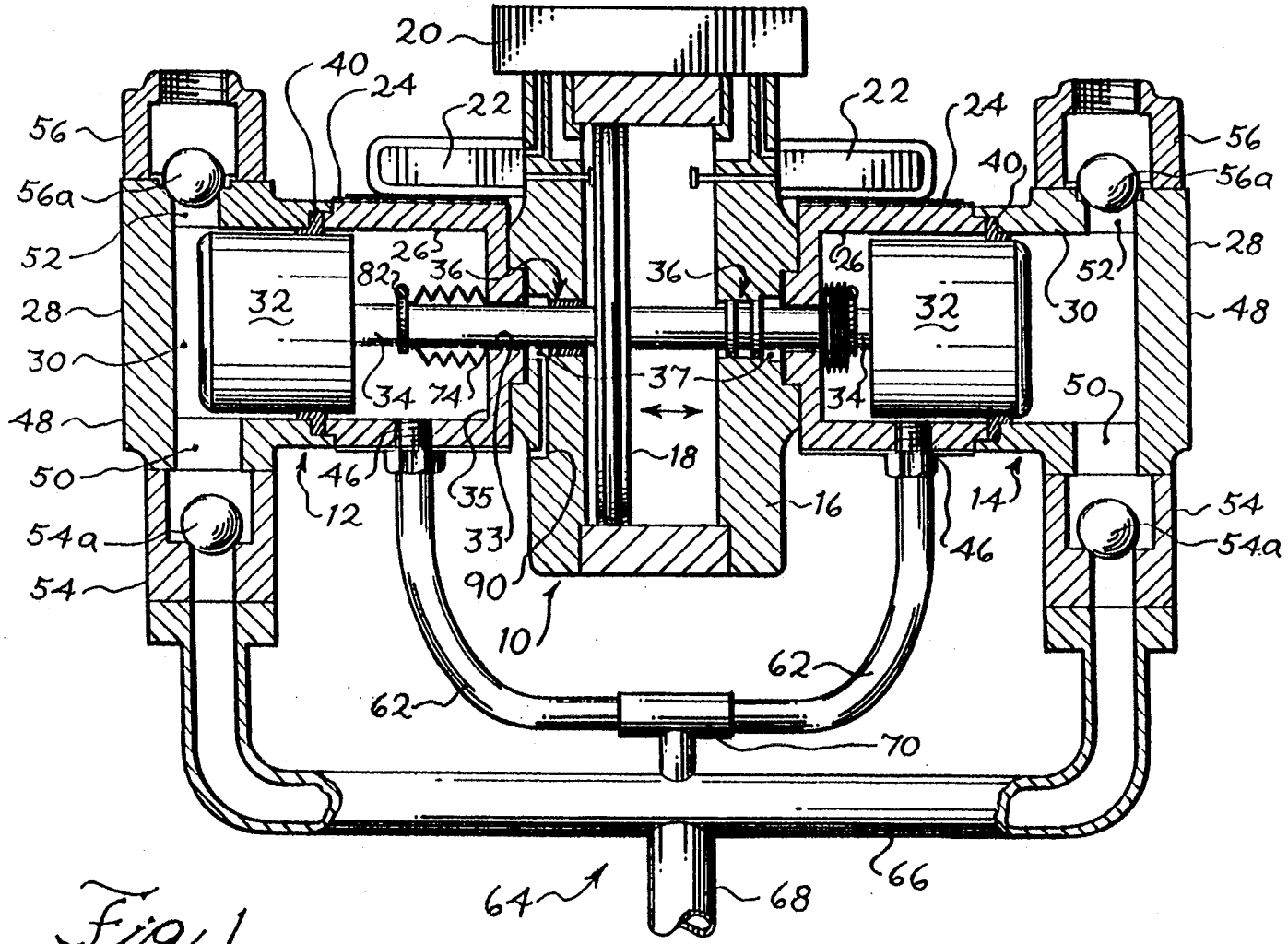
FIG. 1 is a vertical longitudinal section of a preferred embodiment of the pump assembly of the present invention.

Referring to FIG. 1, the pump assembly of the invention is usually oriented with its axis of reciprocation horizontal and is comprised of a central actuator 10 and a pair of piston pumps 12 and 14 at opposite sides of the actuator 10.

The actuator 10 is preferably a fluid actuated dual acting reciprocating piston motor but it could also be a mechanically or electrically driven reciprocating actuator. For most industrial applications, due to the customary availability of compressed air, the actuator will usually be air operated. However, with the unique construction of the pump of the invention, it is also feasible to use a hydraulic actuated reciprocating motor.

In the preferred embodiment, as shown in FIG. 1, the actuator 10 is an air operated motor of a type well-known in the art. The motor is comprised, in essence, of a cylinder 16 having a larger diameter than the pump pistons, a piston 18 reciprocal in and having a sealed relationship with the peripheral wall of the cylinder 16, an air control valve 20 for supplying compressed air alternately to the opposite sides of the piston 18, and a pair of pilot valves 22 which are actuated by the piston 18 adjacent the opposite ends of its stroke of movement to cause the air control valve to supply air to one side of the piston 18 (the left side as viewed FIG. 1) while venting the cylinder at the opposite side of the piston 18 to cause the piston 18 to reciprocate back and forth. At such times as the pump piston area times the fluid pressure in one of the pumps equals the piston area times the air pressure in the motor 10, the piston 18 will halt its movement until fluid is withdrawn from the pump, whereupon the motor piston will resume its reciprocatory movement.

The pumps 12 and 14, as shown in FIG. 1, are of the same construction, but may be of different sizes or utilize different materials of construction as will presently appear. Each pump is comprised of a dynamic chamber block 24 defining a dynamic chamber 26, an output block 28 defining a pumping chamber 30, a piston 32 reciprocable within the dynamic and pumping chambers, and a piston rod 34 extending through an orifice 33 centrally located in an end wall 35 of the dynamic chamber 26 from the pump piston 32 to the motor piston 18, thereby coupling the pump piston 32 to the motor piston 18 for mutual reciprocation.

Each end wall of the motor cylinder 16 is provided with a seal assembly 36 for supporting and guiding the respective piston rod 34 and for establishing a seal between the piston rod 34 and the motor 10 to prevent or at least mitigate wasteful leakage of motor fluid from the motor 10. The seals comprise "quad" type ring sets **36*a*, 36*b* located on opposite sides of a spacer 39. The present invention further contemplates an annular isolation chamber 37 provided on the exterior wall of the motor cylinder 16 and juxtaposed between the seal assembly 36 and the dynamic block 24**, as will be discussed in further detail below.

As illustrated in FIG. 1, the reciprocation of the air motor piston 18 causes the pumps 12 and 14 to be operated alternately, i.e., the piston 18 drives the piston 32 of one pump forward on a pressure producing stroke and drives the piston 32 of the other pump rearward on a suction producing stroke, and then reverses to drive the one pump piston 32 on a suction stroke and the other pump piston 32 on a pressure stroke. In accordance with an aspect of the invention, the reciprocatory stroke of the pistons is short, i.e., in the order of about 1½ to 2 inches for purposes to be described.

Figure 2:
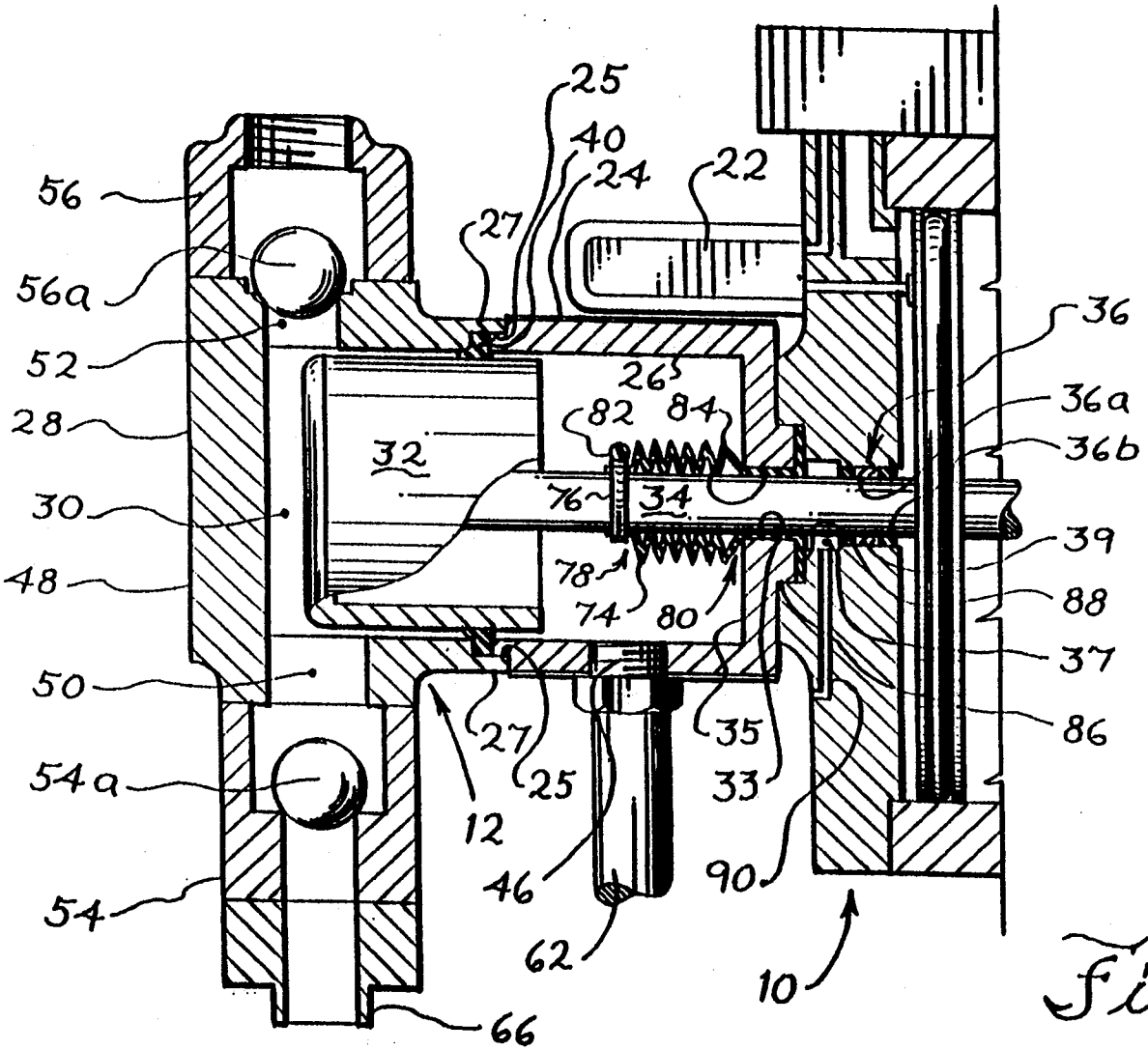
FIG. 2 is a vertical longitudinal sectional view, on an enlarged scale, of one of the single acting pumps incorporated in the pump assembly of FIG. 1.

As shown in the enlarged scale of FIG. 2, the dynamic chamber 26 and the pumping chamber 30 are cylindrical, preferably of the same diameter, and aligned axially with one another. The two blocks 24 and 28 may be of rectangular or similar cross-section so that assembly and mounting bolts (not shown) can be extended longitudinally through the four corner portions of the blocks to secure the two blocks to one another and the adjacent end wall of the motor cylinder. Preferably, at their mating ends, the dynamic block 24 has an undercut 25 and the output block 28 has an axially extending annular lip 27 of a diameter to mate with the undercut 25 to assure axial alignment of the two blocks. Clamped between the abutting faces of the two blocks, by means of the bolts, is a multipurpose seal 40, one purpose of which is to establish a seal between the two blocks.

The piston 32 is of a smaller diameter than and has its periphery spaced inwardly from, i.e., in inwardly spaced gap relation to, the peripheral walls of the chambers 26 and 30 so that there is no metal to metal contact between the piston 32 and the walls of the chambers and fluent material to be pumped may enter into the annular space between the piston periphery and the peripheral wall of the pumping chamber 30. As shown in FIG. 2, the piston 32 is retained in axial alignment with the chambers 26 and 30 by the piston rod seal assembly 36.

In addition, in the preferred embodiment, the seal 40 assists in maintaining the axial alignment of the piston in the pumping chamber. Though the seals illustrated in FIG. 2 have been in public use for some time, the same comprise a significant component of the preferred embodiment of the invention. The seal 40 comprises a relatively rigid annular body portion which is sealingly clamped at its outer marginal portions between the dynamic block 24 and the output block 28, and which extends radially inwardly to and engages the periphery of the piston 32. Preferably the inner diameter of the body portion of the seal is the same as the outer diameter of the piston so that there is a very tight, piston guiding fit between them. Extending forwardly into the pumping chamber from the inner marginal portion of the seal body is an annular sealing and wiping lip, which has an interference fit with the piston.

On the pressure stroke of the piston 32, fluent material being pumped enters into the space between the peripheral wall of the pumping chamber and the lip of the seal 40 and forces the lip into very intimate and pressure sealed relationship with the piston 32 to prevent or mitigate against leakage of the fluent material past the piston 32 and to maintain pressure on the material being pumped. On the suction stroke of the piston 32, the lip, due to its shape and interference fit with the piston 32, wipes the piston 32 clean as the piston 32 moves rearwardly through the seal. Thus the lip performs a piston sealing and wiping function while the body performs a piston guiding function and a sealing function between the blocks 24 and 28. To facilitate the attainment of these functions over a long service life, the seal 40 is preferably formed of ultra high molecular weight polyethylene ("UHMWPE").

In operation, the piston 32 is not withdrawn from the seal 40 during reciprocation. The piston 32 has a length in relation to its reciprocal path of movement such that the piston 32 remains in continuous engagement with the seal 40. For example, with a reciprocatory stroke in the order of 1½ to 2 inches, the piston may have a length in the order of 2½ to 3 inches. Each piston 32 is preferably hollow, i.e., with an end wall facing into the respective pumping chamber 30 and with an annular peripheral wall or skirt extending rearwardly into the dynamic chamber 26, as shown in FIG. 2. The hollow interior of the piston thereby provides a surge chamber within the dynamic chamber which, on the return or suction stroke of the piston, causes a gradual build up of pressure in the dynamic chamber, rather than a sharp pressure spike upon the return movement of the piston into the dynamic chamber.

In the preferred embodiment of the pump illustrated in FIGS. 1–4, the dynamic chamber 26 is maintained in constant closed circuit communication with a pump inlet check valve 54 through a port 46 in the dynamic chamber wall and a conduit 62 extending from the port 46 to the inlet check valves 54. In the preferred embodiment, a fluent delivery system 64 includes an inlet manifold 66 which communicates with both pump inlets 54 and is supplied by a fluent supply conduit 68. In this embodiment, the conduits 62 are directed to a tee connector 70 providing a common inlet orifice to the manifold 66, preferably located equidistantly from the inlet check valves 54. Consequently, the two dynamic chambers 28 are in constant closed-circuit communication with one another and the fluent material inlet system of the pumps.

Thus, any fluent material leaking past a piston seal 40 will be returned to the fluent delivery system 64 and otherwise contained within a closed system, such that waste is prevented and environmentally controlled fluent materials are not allowed to escape to the atmosphere. Fluent material in one dynamic chamber 26 is simply allowed to pass back and forth between the two chambers 26 via the ports 46, conduits 62, connector 70 and inlet manifold 66. Thus, pressurization of the dynamic chamber 26 of each of the pumps 12, 14, during their respective suction strokes, and the attendant impediment to the efficiency of the pumps created thereby, is eliminated. Moreover, as the dynamic chambers of the two pump units are in common fluid communication with the fluent material delivery system, the fluent material pressure within the dynamic chambers 26 is maintained substantially equal.

By virtue of the closed circuit system thus established, each of the pumps is rendered leak-proof. The piston rod seal at the end wall of the dynamic chamber 26 thus becomes very critical to maintenance of the integrity of the closed circuit system. An important feature of the invention resides in the interposition of an articulating moveable seal member 74 between the end wall 35 of the dynamic chamber 26 and the piston rod 34. The articulating moveable seal member 74 preferably comprises the bellows seal shown in detail in FIG. 3. The bellows seal 74 has a first cylindrical end 78 having an inner diameter equal to the outer diameter of the piston rod and positioned about the rod to overlie a pair of annular grooves 76 formed in the circumference of the rod 34, best shown in FIG. 4. As shown in FIGS. 1 and 2, the first end 78 of the bellows is positioned about the annular grooves 76 and the material of the seal is forced into the grooves by means of a clamp 82 thereby to fixedly secure the end 78 to the rod in intimately sealed relationship with the rod. The clamp 82 may suitably be a hose clamp.

A second end 80 of the bellows seal 74 sealingly doses an annular gap between the piston rod 34 and the dynamic chamber end wall orifice 33. The end 80 includes a cylindrical portion 84 of a length and diameter substantially the same as the orifice 33 and terminates in a radially outwardly extending annular lip or flange 88. Each end wall of the motor cylinder 16 is provided with a shallow, cylindrical recess 86, which preferentially is of a depth slightly less than the width W of the lip or flange 88. As shown, the lip 88 is sealingly clamped at its outer periphery 92 between the dynamic block 24 and the motor cylinder 16, thereby to seal the piston rod 34 to the dynamic chamber 26 and to establish and maintain the closed circuit integrity of the pump input system. In addition, the bellows seal 74 seals the isolation chamber 37 between the seal assembly 36 and the dynamic chamber 26. The bellows seal 74 is expandable and contractible to accommodate the reciprocating stroke of the piston rod 34 and is preferably manufactured from Tentite Polyallomer 5021, having preferentially been pre-stressed by compression to its minimum solid height to improve its service life. Although shown in detail in FIG. 3 with seven convolutions 94, more or less convolutions 94 may be used in accordance with the stroke of the piston 32 and piston rod 34. As shown in FIG. 4, the piston rod 34 is preferentially provided with wrench flats 96 to allow the application of torque to the rod 34 for purposes of assembly and disassembly of the unit.

The present invention thus effectively seals the dynamic chamber 26 from the isolation chamber 37 under virtually all possible operating and seal wear conditions. Moreover, the isolation chamber 37 is vented via passage 90, thereby enabling the interior of the bellows seal 74 to breathe, i.e., to expand and contract with piston rod movement without internal resistance. In the case of air motor actuation, should air leak through the seal assembly 36, the air can vent harmlessly to the atmosphere via passage 90. The sound created by such venting provides an audible warning of leakage past the seal assembly 36 and the need to replace the same. If the actuating fluid is hydraulic fluid, the passage 90 can be connected to a conduit (not shown) for return to the hydraulic fluid source. In such case, transparent conduits can alert operators to leakage which may occur through the seal assembly 36. Consequently, in the practice of the present invention, hydraulic motors may be utilized as actuators, as well as air motors.

The pumping chamber 30 defined by the output block 28 is a blind end chamber having a peripheral wall and an end wall 48. Inlet and outlet ports 50 and 52 are formed in the peripheral wall of the output block adjacent to and preferably contiguous to, the end wall 48. To facilitate the flow of fluent material, the inlet port 50 is of a larger diameter than the outlet port 52, but the ports are otherwise aligned with one another, substantially coaxially, diametrically across the pumping chamber 30. The inlet 50 is provided with an inlet check valve 54 and the outlet is provided with an outlet check valve 56. Each valve is preferably comprised of a ball **54*a*–56*a* forming the movable valve element. In the illustrated embodiment the inlet 50 and the outlet 52** are aligned vertically with one another, and the balls are seated and unseated by the negative and positive pressures generated by the piston. Other check valves may of course be utilized.

As the piston 32 is moved rearwardly on its suction stroke by the motor 10, the outlet check ball **56*a* will be seated on its seat and the inlet check ball 54*a* will be lifted from its seat and fluent material will be sucked from the fluent delivery manifold 66 through the check valve 54 and the pump inlet 50 into the pumping chamber 30. Then, as the piston reverses its direction and is moved forwardly, the inlet check ball 54*a* is closed, and the outlet check ball 56*a* is forced upwardly by the fluent material being pushed forward under pressure by the piston 32, and the fluent material will be delivered under pressure via the outlet 52** to a point of use, for example, a spray gun or the like.

As the piston continues to reciprocate, fluent material will be pulled into and discharged from the pumping chamber and will pass essentially diametrically through the pumping chamber 30 in a substantially straight line path of fluid flow. Because the stroke of the piston is short and the pumping chamber is not large, there will be very little deviation of the fluent material from a straight line path of fluid flow. This is very beneficial when pumping any viscous material, but is especially important when pumping extremely abrasive materials, materials that are shear sensitive, and materials that are heat sensitive and can solidify due to heat generated by friction.

Servicing and repair of the pump is effectuated quickly and easily by simply removing the mounting bolts, removing the output block from the dynamic block, as well as the dynamic block from the actuator, removing and replacing the seal, and reassembling the blocks and bolting the same together.

By providing different sized motors 10 and/or different sizes of pump units 12, 14, a variety of different pump output pressures and rates of flow can be provided. This can be accomplished by combining different air motors with different sized pump units. The pump thus also lends itself to fabrication of pump units of modular designs so that one of the pump units 12, 14 can be made of one size and the other of another size thereby to provide different output pressures and/or flow rates and to accommodate the pumping of different fluent materials. This also facilitates use of the pump assembly for metering two or more components of a plural component fluent composition.

In addition to sucking fluent material directly from a source of supply, the inlet to the pumps 12 and 14 can be force fed from a pressurized source, an overhead tank providing a pressure head, or another pump. There is no impediment to supercharging the material at the inlet to the pump of the invention. Consequently, the pump is capable of handling materials that could not be handled with many of the prior art pumps, such as extremely viscous materials. According to the present invention, any fluent material which may leak past the piston seal 40 is safely contained within the sealed dynamic chamber fluent delivery system without waste, without exposure to the atmosphere, and without compromising the efficiency of the pumps 12, 14. Further, fluent material in the dynamic chamber 26 is isolated by the articulating moveable seal member 74 and prevented from passing into the actuator 10. Also, the isolation chamber 37 in combination with the articulating moveable seal member 74 prevents motor fluid from intermingling with any fluent material within the dynamic chamber 26. Finally, the isolation chamber 37 in combination with the vent passage 90 prevents pressurization of the interior of the bellows seal 74 and prevents possible damage thereto.

The closed circuit dynamic chamber of the invention, in combination with their bellows seals 74 and return conduits 62, thereby provide a leak-proof pump capable of handling a wide variety of materials efficiently and effectively without imperiling the ambient environment.

Figure 5:
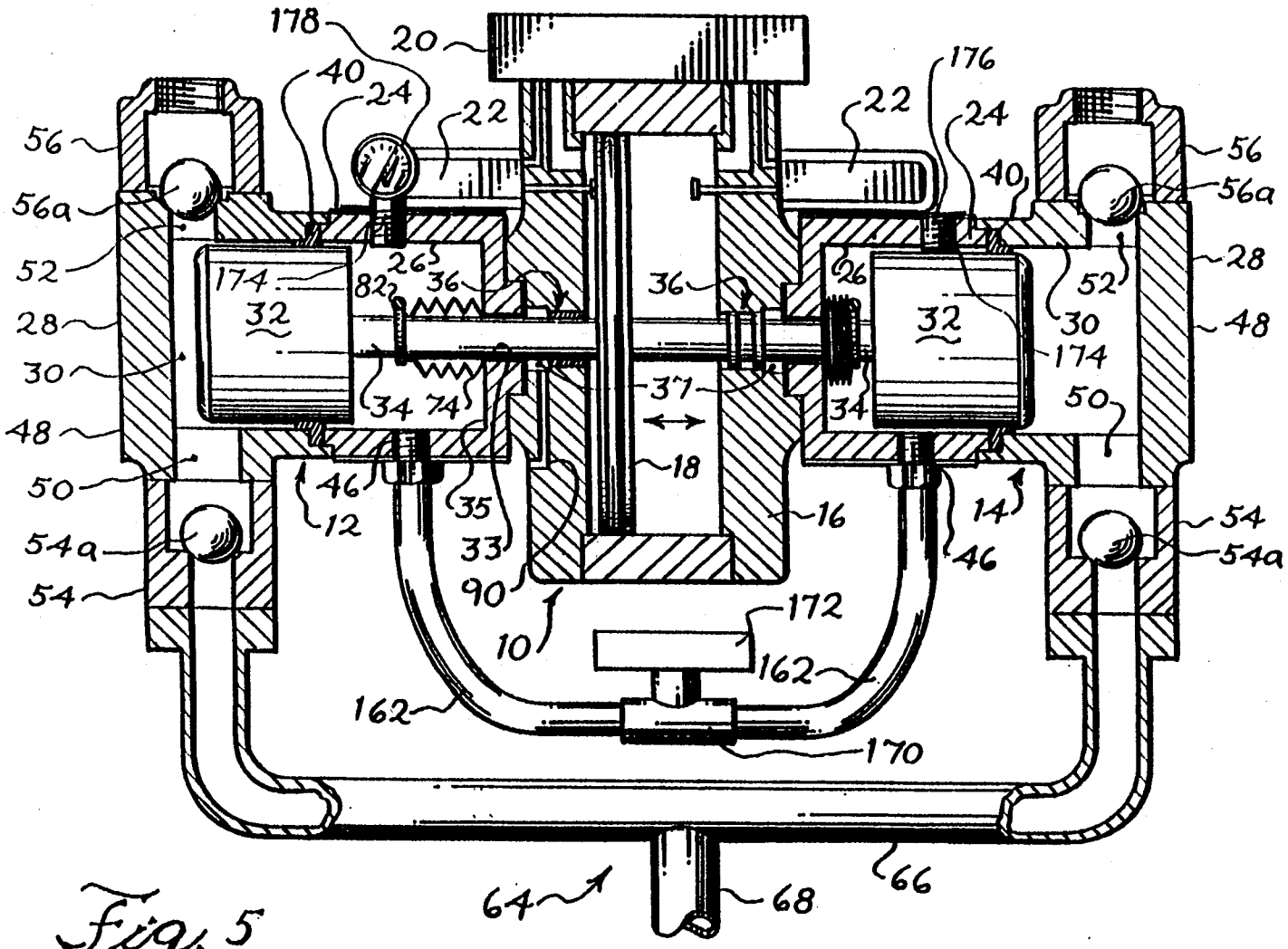
FIG. 5 is a schematic illustration of a second embodiment of the pump having a modified fluid circuit and illustrating therewith a piston seal test gauge.

Referring now to the FIG. 5, a second embodiment of the pump is shown wherein the dynamic chambers 28 of the two pumps are directly interconnected without connection to the fluent material delivery system 64. This enables the supply of a different fluid to the dynamic chambers, for example, a fluid for flushing the peripheral wall of the piston on each suction or return stroke thereby to cleanse the piston wall, to lubricate the piston seal 40 on the forward or pressure stroke of the piston, and to prevent accumulation of abrasive particles between the piston and the seal.

In the system illustrated in FIG. 5, conduits 162 lead from the dynamic chamber ports 46 to a common connector 170. The connector 170 is preferably a tee connector having a third port to which a suitable source of fluid supply may be connected. In the illustrated embodiment, the source of supply is simply a fluid container 172 containing a suitable solvent for the material being pumped. If the solvent is volatile, i.e., containing VOC's, the container will be a closed container providing a closed circuit for circulating the solvent back and forth between the two dynamic chambers. If the solvent is not volatile, the container may, if desired, be vented to atmosphere. In all other respects, the FIG. 5 embodiment has the same mode of operation and provides all of the advantages of the embodiment of FIGS. 1–4.

FIG. 5 also illustrates a further adjunct that may be incorporated in the pump assembly to facilitate testing of the pump units and trouble-shooting of any problems that may arise. Specifically, each of the dynamic chamber blocks 24 may be provided, preferably at the top side of the pump, with a tapped bore 174 extending through the peripheral wall and communicating with the dynamic chamber 28. The bore 174 is normally sealed closed by a pipe plug 176 as illustrated at the right hand side of FIG. 5. However, when it is desired to do so, the effectiveness of the piston seal 40 of the respective pump unit may be tested by removing the plug 176 and threading into the tapped bore 174 a combination pressure and vacuum gauge 178 as illustrated at the left hand side of FIG. 5. With the port 46 sealed closed by a plug similar to plug 176, the seals of the pump, especially the piston seal, should be able to retain a positive pressure in the order of about twenty pounds per square inch (psi) and a vacuum pressure in the order of about four inches water column. If not, the bellows seal 74 should be inspected and the piston seal 40 replaced. If the indicated pressures are maintained, there is no need for service. Thus, in this manner, the integrity of the piston seal may easily be determined without requiring disassembly of the pump unit.

The objects and advantages of the invention have thus been shown to be attained in an economical, practical and facile manner.

While preferred embodiments of the invention have been herein illustrated and described, it is to be appreciated that various changes, rearrangements and modifications may be made therein, without departing from the scope of the invention as defined by the appended claims.

What is claimed is:

1. A pump assembly for pumping fluent materials including a pump unit comprising:

an outlet block defining a pumping chamber, the pumping chamber having a peripheral wall and an end wall;

an inlet in the pumping chamber peripheral wall proximate the pumping chamber end wall and in communication with the pumping chamber, the inlet having a check valve;

an outlet from the pumping chamber peripheral wall proximate the pumping chamber end wall and in communication with the pumping chamber, the outlet having a check valve;

a dynamic block defining a dynamic chamber and abutting the outlet block, the dynamic chamber having a peripheral wall coaxial with the pumping chamber peripheral wall and having an end wall, the dynamic chamber having an outlet:

a piston reciprocal within the pumping chamber and the dynamic chamber, the piston being of a smaller diameter than and having its periphery in inwardly spaced gap relation to the peripheral walls of the pumping chamber and the dynamic chamber;

a piston rod extending from the piston through an orifice in the end wall of the dynamic chamber for imparting reciprocal strokes of movement to the piston;

an articulating moveable seal member having a first end sealingly engaged with the piston rod and a second end sealingly engaged with the dynamic chamber end wall, the articulating moveable seal member sealing the piston rod to the dynamic chamber end wall and accommodating reciprocal movement of the piston rod relative to the wall;

a piston seal clamped between the outlet block and the dynamic block, the seal extending inwardly into engagement with the periphery of the piston, the seal sealing the outlet block to the dynamic block and the outlet block to the piston, the periphery of the piston being in continuous engagement with the seal and remaining spaced from all other surfaces within the pump;

means including the piston rod for reciprocating the piston within the pumping chamber and the dynamic chamber; the dynamic chamber receiving therein fluent material leaking past the piston seal from the pumping chamber; and a closed circuit recirculating system in continuously open fluid communication with the dynamic chamber outlet for receiving and recirculating fluent material leaking past the piston seal to thereby prevent fluent material from escaping into the environment; the recirculating system and the dynamic chamber thereby forming a leak-proof pump.

2. A pump assembly as set forth in claim 1, wherein said recirculating system comprises passage means establishing continuously open fluid communication between the dynamic chamber outlet and the pumping chamber inlet.

3. A pump assembly as set forth in claim 1, wherein said recirculating system comprises a fluid material source of supply and passage means establishing continuously open fluid communication between the dynamic chamber outlet and the source of supply, the recirculating system continuously maintaining the dynamic chamber filled with fluid from the source of supply for flushing the periphery of the piston and the piston seal as the piston reciprocates within said chambers.

4. A pump assembly as set forth in claim 1, comprising two of the pump units, a reciprocal actuator interposed between the pump units, and a fluent material introducing means in communication with the inlets of the pump units;

the piston rods of the pump units being connected to the actuator for alternate actuation by the actuator;

the dynamic chambers of the two pump units having outlets in continuously open fluid communication with one another such that the fluid pressure in the dynamic chambers is maintained substantially equal.

5. A pump assembly as set forth in claim 4, including a fluid material source of supply and passage means establishing continuous communication between the outlets of the dynamic chambers and the fluid material source of supply.

6. A pump assembly for pumping fluent materials including two pump units each comprising:

an outlet block defining a pumping chamber, the pumping chamber having a peripheral wall and an end wall;

an inlet in the pumping chamber peripheral wall proximate the pumping chamber end wall and in communication with the pumping chamber, the inlet having a check valve;

an outlet from the pumping chamber peripheral wall proximate the pumping chamber end wall and in communication with the pumping chamber, the outlet having a check valve;

a dynamic block defining a dynamic chamber and abutting the outlet block, the dynamic chamber having a peripheral wall coaxial with the pumping chamber peripheral wall and having an end wall, the dynamic chamber having an outlet;

a piston reciprocal within the pumping chamber and the dynamic chamber., the piston being of smaller diameter than and having its-periphery in inwardly spaced gap relation to the peripheral walls of the pumping chamber and the dynamic chamber;

a piston rod extending from the piston through an orifice in the end wall of the dynamic chamber for imparting reciprocal strokes of movement to the piston;

an articulating moveable seal member having a first end sealingly engaged with the piston rod and a second end sealingly engaged with the dynamic chamber end wall, the articulating moveable seal member sealing the piston rod to the dynamic chamber end wall and accommodating reciprocal movement of the piston rod relative to the wall;

a piston seal clamped between the outlet block and the dynamic block, the seal extending inwardly into engagement with the periphery of the piston, the seal sealing the outlet block to the dynamic block and the outlet block to the piston, the periphery of the piston being in continuous engagement with the seal and remaining spaced from all other surfaces within the pump; and means including the piston rod for reciprocating the piston within the pumping chamber and the dynamic chamber;

the reciprocating means comprising a reciprocal actuator interposed between the two pump units, the piston rods of the pump units being connected to the actuator for alternate actuation by the actuator;

a fluent material introducing means in communication with the inlets of the pump units;

the dynamic chambers of the two pump units having outlets in fluid communication with one another for receiving a fluid and such that the fluid pressure in the dynamic chambers is maintained substantially equal; and a closed circuit recirculating system in fluid communication with the dynamic chamber outlets and forming therewith a leak-proof pump, said system including passage means establishing continuous communication between the outlets of the dynamic chambers and the fluent material introducing means.

7. A pump assembly as set forth in claim 4, including a common manifold connecting the outlets of the dynamic chambers of the two pump units in continuous closed circuit fluid communication with one another and a source of fluid supply.

8. A pump assembly as set forth in claim 4, including a common manifold for delivering a fluent material to the fluid inlets of both of the pump units, the outlets of the dynamic chambers of the two pump units being in continuous closed circuit fluid communication with the common manifold.

9. A pump assembly especially adapted for pumping viscous and abrasive fluent materials comprising:

a dynamic block defining a dynamic chamber, the dynamic chamber having an end wall, a peripheral wall and an open end;

an output block abutting the dynamic block and defining a pumping chamber coaxial with the dynamic chamber, the pumping chamber having a peripheral wall and an end wall remote from the dynamic chamber, the pumping chamber being open at the end thereof adjacent the open end of the dynamic chamber;

means for securing the open end of the output block to the open end of the dynamic block;

a piston reciprocable axially within the dynamic and pumping chambers and movable forwardly toward and rearwardly away from the end wall of the pumping chamber, the piston being of smaller diameter than and having its periphery in inwardly spaced gap relation to the peripheral walls of the chambers;

an annular seal clamped between the open ends of the peripheral walls of the output block and the dynamic block and sealing the walls one to the other, the seal extending inwardly into sealed engagement with the periphery of the piston;

an inlet in communication with the pumping chamber;

means for introducing into the inlet fluent material to be pumped;

an inlet check valve in the inlet between the pumping chamber and the fluent material introducing means;

an outlet in communication with the pumping chamber;

an outlet check valve in the outlet;

a reciprocal actuator adjacent the dynamic chamber end wall having a reciprocatory stroke of movement;

a piston rod extending from the piston through the dynamic chamber and through an orifice in the dynamic chamber end wall to the actuator and coupling the piston with the actuator for imparting reciprocal strokes of movement to the piston, the piston rod having seal receiving means thereon positioned within the dynamic chamber;

an articulating moveable seal member having a first end affixed to and sealingly engaged with the seal receiving means on the piston rod and a second end sealingly engaged with the dynamic chamber end wall about the orifice through the dynamic chamber end wall, the articulating moveable seal member sealing the piston rod to the dynamic chamber end wall and accommodating reciprocal movement of the rod;

the piston being of a length in relation to its reciprocal path of movement that the periphery of the piston remains continuously in engagement with said annular seal and engages only the annular seal;

the actuator reciprocating the piston through a rearward suction stroke for drawing fluent material into the pumping chamber through the inlet and a forward pressure stroke for forcing fluent material from the pumping chamber through the outlet; the dynamic chamber receiving therein fluent material leaking past the annular seal from the pumping chamber;

the peripheral wall of the dynamic chamber having a port therethrough; and a closed circuit recirculating system in continuously Open fluid communication with the port in the dynamic chamber for receiving and recirculating fluent material leaking past the annular seal to thereby prevent fluent material from escaping into the environment; the recirculating System and the dynamic chamber rendering the pump leak-proof.

10. A pump assembly as set forth in claim 9, wherein the seal receiving means on the piston rod includes a circumferential groove and the pump assembly includes an annular clamp positioned on the first end of the articulating moveable seal member for forcing the seal member into the groove to fixedly and sealingly secure the first end of the articulating seal member to the piston rod.

11. A pump assembly as set forth in claim 9, wherein the articulating moveable seal member is a bellows seal.

12. A pump assembly as set forth in claim 9, wherein the closed circuit recirculating system comprises passage means establishing continuously open fluid communication between the port in the dynamic chamber and the fluent material introducing means.

13. A pump assembly as set forth in claim 7, wherein the closed circuit recirculating system comprises a source of supply of a fluid other than the fluid material to be pumped and passage means establishing continuously open fluid communication between the port in the dynamic chamber and said source of supply.

14. A pump assembly as set forth in claim 9, wherein the actuator comprises a motor cylinder having a wall abutting the dynamic chamber end wall, the motor cylinder wall having a shallow, cylindrical recess therein concentric with and of a diameter larger than the orifice in the dynamic chamber end wall;

the second end of the articulating moveable seal member extending through the orifice in the dynamic chamber end wall and having a radially outwardly extending flange seated within the shallow recess, the flange being sealingly clamped between the dynamic block and the motor cylinder wall to seal the dynamic chamber and isolate the dynamic chamber from the actuator.

15. A pump assembly as set forth in claim 14, including a seal assembly in the motor cylinder wall for supporting and guiding the piston rod and for establishing a seal between the piston rod and the actuator, the motor cylinder wall having an isolation chamber therein between the seal assembly and the articulating moveable seal member, the isolation chamber being vented to the exterior of the dynamic block and the motor cylinder.

16. A pump assembly especially adapted for pumping viscous and abrasive fluent materials comprising:

a dynamic block defining a dynamic chamber, the dynamic chamber having an end wall, a peripheral wall and an open end;

an output block abutting the dynamic block and defining a pumping chamber coaxial with the dynamic chamber, the pumping chamber having a peripheral wall and an end wall remote from the dynamic chamber, the pumping chamber being open at the end thereof adjacent the open end of the dynamic chamber;

means for securing the open end of the output block to the open end of the dynamic block;

a piston reciprocable axially within the dynamic and pumping chambers and movable forwardly toward and rearwardly away from the end wall of the pumping chamber, the piston being of smaller diameter than and having its periphery in inwardly spaced gap relation to the peripheral walls of the chambers;

an annular seal clamped between the open ends of the peripheral walls of the output block and the dynamic block and sealing the walls one to the other, the seal extending inwardly into sealed engagement with the periphery of the piston;

an inlet in communication with the pumping chamber;

means for introducing into the inlet fluent material to be pumped;

an outlet in communication with the pumping chamber;

a reciprocal actuator adjacent the dynamic chamber end wall having a reciprocatory stroke of movement;

a piston rod extending from the piston through the dynamic chamber and through an orifice in the dynamic chamber end wall to the actuator and coupling the piston with the actuator for imparting reciprocal strokes of movement to the piston, an articulating moveable seal member having a first end affixed to and sealingly engaged with the piston rod and a second end sealingly engaged with the dynamic chamber end wall about the orifice through the dynamic chamber end wall, the articulating moveable seal member sealing the piston rod to the dynamic chamber end wall and accommodating reciprocal movement of the rod;

the piston being of a length in relation to its reciprocal path of movement that the periphery of the piston remains continuously in engagement with said annular seal and engages only the annular seal;

the actuator reciprocating the piston through a rearward suction stroke for drawing fluent material into the pumping chamber through the inlet and a forward pressure stroke for forcing fluent material from the pumping chamber through the outlet; the dynamic chamber receiving therein fluent material leaking past the annular seal from the pumping chamber;

the actuator comprising a motor cylinder having a wall abutting the dynamic chamber end wall and including a seal assembly in the motor cylinder wall for supporting and guiding the piston rod and for establishing a seal between the piston rod and the actuator, the motor cylinder wall having an isolation chamber therein between the seal assembly and the articulating moveable seal member, the isolation chamber being vented to the exterior of the dynamic block and the motor cylinder;

the peripheral wall of the dynamic chamber having a port therethrough; and a closed circuit recirculating system in continuously open fluid communication with the port in the dynamic chamber for receiving and recirculating fluent material leaking past the annular seal to thereby prevent fluent material from escaping into the environment; the recirculating system and the dynamic chamber thereby rendering the pump leak-proof.

* * * * *